US011619910B2

(12) United States Patent
Tombez et al.

(10) Patent No.: US 11,619,910 B2
(45) Date of Patent: Apr. 4, 2023

(54) TIMEPIECE INCLUDING A MECHANICAL MOVEMENT WHOSE OPERATION IS CONTROLLED BY AN ELECTRONIC DEVICE

(71) Applicant: The Swatch Group Research and Development Ltd, Marin (CH)

(72) Inventors: Lionel Tombez, Bevaix (CH); Laurent Nagy, Liebefeld (CH); Alexandre Haemmerli, Neuchatel (CH)

(73) Assignee: The Swatch Group Research and Development Ltd, Marin (CH)

( * ) Notice: Subject to any disclaimer, the term of this patent is extended or adjusted under 35 U.S.C. 154(b) by 869 days.

(21) Appl. No.: 16/572,996

(22) Filed: Sep. 17, 2019

(65) Prior Publication Data

US 2020/0103826 A1 Apr. 2, 2020

(30) Foreign Application Priority Data

Sep. 28, 2018 (EP) ..... 18197529

(51) Int. Cl.
*G04B 17/06* (2006.01)
*G04B 17/22* (2006.01)
*G04C 3/04* (2006.01)

(52) U.S. Cl.
CPC ..... *G04B 17/063* (2013.01); *G04B 17/222* (2013.01); *G04C 3/04* (2013.01)

(58) Field of Classification Search
CPC ..... G04C 3/04; G04C 3/12; G04B 17/063; G04B 17/222
See application file for complete search history.

(56) References Cited

U.S. PATENT DOCUMENTS 3,781,955 A * 1/1974 Lavrinenko ..... H03H 9/176 29/25.35
10,969,745 B2 * 4/2021 Haemmerli ..... G04B 17/227
(Continued)

FOREIGN PATENT DOCUMENTS

CH 697 207 A5 6/2008
CH 705 679 A2 4/2013
(Continued)

OTHER PUBLICATIONS

Japanese Office Action dated Nov. 10, 2020 in Japanese Patent Application No. 2019-171186 (with English translation), 6 pages.
(Continued)

*Primary Examiner* — Edwin A. Leon
*Assistant Examiner* — Jason M Collins
(74) *Attorney, Agent, or Firm* — Oblon, McClelland, Maier & Neustadt, L.L.P.

(57) ABSTRACT

A timepiece includes a mechanical oscillator, formed by a balance and a piezoelectric balance spring, and a control device for controlling the frequency of the mechanical oscillator. This control device is arranged to be capable of generating time-separated control pulses, each including a momentary decrease in an electrical resistance applied by the control device between two electrodes of the piezoelectric balance spring relative to a nominal electrical resistance. The control device is arranged to be capable of applying a plurality of control pulses during each time of a series of distinct correction times or without interruption in a continuous time window, in order to respectively synchronize the mechanical oscillator at a correction frequency whose value depends on a detected positive or negative temporal drift or at a desired frequency for the mechanical oscillator.

22 Claims, 6 Drawing Sheets

(56) References Cited

U.S. PATENT DOCUMENTS

| | | | | |
|---|---|---|---|---|
| 2005/0073913 | A1* | 4/2005 | Born | G04C 10/00 368/127 |
| 2013/0051191 | A1 | 2/2013 | Schafroth | |
| 2013/0107677 | A1* | 5/2013 | Willemin | G04C 3/067 368/200 |
| 2015/0234352 | A1 | 8/2015 | Hessler et al. | |
| 2019/0286063 | A1* | 9/2019 | Nagy | G04B 17/28 |
| 2020/0103827 | A1* | 4/2020 | Tombez | G04C 3/047 |

FOREIGN PATENT DOCUMENTS

| | | | |
|---|---|---|---|
| CN | 101878454 | A | 11/2010 |
| CN | 103092057 | A | 5/2013 |
| CN | 104849994 | A | 8/2015 |
| CN | 104850000 | A | 8/2015 |
| CN | 106104393 | A | 11/2016 |
| DE | 10 2009 005 357 | A1 | 8/2010 |
| EP | 1 164 441 | A1 | 12/2001 |
| EP | 1 605 323 | A2 | 12/2005 |
| EP | 2 224 293 | A2 | 9/2010 |
| EP | 2 908 187 | A1 | 8/2015 |
| JP | 2002-228774 | A | 8/2002 |
| JP | 2004-69980 | A | 3/2004 |
| WO | WO 2011/066362 | A1 | 6/2011 |

OTHER PUBLICATIONS

Combined Chinese Office Action and Search Report dated Feb. 1, 2021 in Chinese Patent Application No. 201910924692.1, 7 pages.
European Search Report dated Apr. 9, 2019 in European Application No. 18197529.3, filed Sep. 28, 2018 (with English Translation of Categories of Cited Documents).

* cited by examiner

TIMEPIECE INCLUDING A MECHANICAL MOVEMENT WHOSE OPERATION IS CONTROLLED BY AN ELECTRONIC DEVICE

CROSS-REFERENCE TO RELATED APPLICATION

This application claims priority to European Patent Application No. 18197529.3 filed on Sep. 28, 2018, the entire disclosure of which is hereby incorporated herein by reference.

FIELD OF THE INVENTION

The present invention concerns a timepiece including a mechanical movement, provided with a mechanical oscillator which is formed by a balance and a balance spring, and an electronic control device for controlling the frequency of the mechanical oscillator which controls the operation of the mechanical movement.

In particular, the electronic control device includes an auxiliary oscillator of the electronic type, which is generally more precise than a mechanical oscillator, in particular a quartz oscillator

BACKGROUND OF THE INVENTION

Several documents concern the electronic control of a mechanical oscillator in a timepiece. In particular, US Patent Application No 2013/0051191 concerns a timepiece including a balance/balance spring and an electronic circuit for controlling the oscillation frequency of this balance/balance spring. The balance spring is formed of a piezoelectric material or includes two lateral layers of piezoelectric material on a silicon core, two external lateral electrodes being arranged on the lateral surfaces of the balance spring. These two electrodes are connected to the electronic control circuit which includes a plurality of switchable capacitances arranged in parallel and connected to the two electrodes of the balance spring.

With reference to FIGS. 1 to 4, a timepiece of the type disclosed in the aforementioned US patent application will be described. To avoid overloading the drawing, FIG. 1 represents only mechanical resonator 2 of the mechanical movement of the timepiece, this resonator comprising a balance 4 oscillating about a geometric axis 6 and a balance spring 8 whose terminal curve 10 passes in a conventional manner through a stud 12 integral with a balance-cock (not represented) of the mechanical movement. FIG. 2 schematically represents a portion of balance spring 8. This balance spring is formed by a central silicon body 14, two lateral layers 16, 18 of piezoelectric material, particularly aluminium nitride (AlN), and two external metal electrodes 20, 22. The two electrodes are connected by conductive wires 26, 28 (schematic representation) to an electronic control circuit 24.

FIG. 3 (which reproduces FIG. 1 of the prior art document concerned with some additional information from FIGS. 2 and 7) shows the general arrangement of control device 32 which is incorporated in the timepiece in question and, in particular, the electronic control circuit 24. This circuit 24 includes a first capacitor 34 connected to two electrodes of the piezoelectric balance spring and a plurality of switchable capacitors 36*a* to 36*d* which are arranged in parallel with the first capacitor, so as to form a variable capacitance $C_V$ in order to vary the value of the capacitance connected to the electrodes of the balance spring and thus to vary, according to the teaching of the document, the stiffness of the balance spring. Circuit 24 further includes a comparator 38 whose two inputs are respectively connected to the two electrodes of balance spring 8, this comparator being arranged to provide a logic signal to determine, by means of the successive logic state changes of this logic signal, the zero-crossings of the induced voltage between the two electrodes of the balance spring. The logic signal is provided to a logic circuit 40 which also receives a reference signal from a clock circuit 42 associated with a quartz resonator 44. Based on a comparison between the reference signal and the logic signal provided by comparator 38, logic circuit 40 controls the switches of switchable capacitors 36*a* to 36*d*.

Further, after the switchable capacitor circuit there is arranged a full-wave rectifier circuit 46 conventionally formed of a four-diode bridge, which provides a continuous voltage $V_{DC}$ and loads a storage capacitor 48. This electrical energy provided by the piezoelectric balance spring powers device 32. This is thus an autonomous electrical system, since it is self-powered in the sense that the electrical energy comes from the mechanical energy provided to mechanical resonator 2, whose piezoelectric balance spring 8, forms an electromechanical transducer (an electrical current generator) when the mechanical resonator oscillates.

As indicated in US Patent No 2013/0051191 at paragraph 0052, electronic control circuit 24 can only reduce the oscillation frequency of mechanical resonator 2 by increasing the value of variable capacitance $C_V$. This observation is confirmed by the graph of FIG. 4, which shows the curve 50 giving the daily time error in function of the value of variable capacitance $C_V$. Indeed, it is observed that the daily time error obtained is always less than zero and increases in absolute value when the value of the variable capacitance increases. Thus, the control system requires the natural frequency of the mechanical oscillator (frequency in the absence of regulation) to be higher than the nominal frequency (desired frequency) of this mechanical oscillator. In other words, it is intended to adjust the mechanical oscillator so that its natural frequency corresponds to a frequency higher than the desired frequency, the function of the control circuit being to decrease this natural frequency more or less so that the rate corresponds to the desired frequency. Thus, a great disadvantage of such a system lies in the fact that the rate of the mechanical movement is not optimal in the absence of electronic regulation. For a high precision timepiece movement, it is actually necessary to degrade its natural mechanical features with a non-optimal setting. It can be concluded that such an electronic control system only makes sense for mechanical movements of average quality or even poor quality, since the precision of these mechanical movements depends on the electronic control system.

SUMMARY OF THE INVENTION

It is an object of the present invention to propose a timepiece, provided with a mechanical resonator, comprising a balance spring at least partially formed of a piezoelectric material, and an electronic control system associated with the piezoelectric balance spring, which does not have the drawbacks of the aforementioned prior art timepiece, in particular, which can be associated with a mechanical movement whose functioning is initially set in an optimal manner, i.e. to the best of its abilities. Thus, it is an object of the invention to provide an electronic control system, which, owing to the use of a piezoelectric balance spring, is discrete and autonomous and which is genuinely complementary to the mechanical movement, since it increases its precision without thereby degrading an optimal initial setting of the mechanical movement.

To this end the invention concerns a timepiece including a control device arranged to be capable of regulating the mean frequency of the mechanical oscillator, formed by a balance and a balance spring, which times the running of the timepiece, this control device including an auxiliary time base, formed by an auxiliary electronic oscillator, which provides a reference frequency signal for the control process. The balance spring is at least partially formed by a piezoelectric material and by at least two electrodes arranged to have between them a voltage induced by the piezoelectric material undergoing mechanical stress and electrically connected to the control device which is arranged to be capable of varying the impedance of the control system formed by the piezoelectric material, the at least two electrodes and the control device. The control device is arranged to be capable of momentarily varying the electrical resistance produced by the control device between the at least two electrodes, in order to generate, at least at times, control pulses which are distinct and each have a certain duration $T_P$, each control pulse consisting of a momentary decrease in said electrical resistance relative to a nominal electrical resistance, which is generated by the control device between the two electrodes outside the distinct control pulses. The control device is arranged to be capable of applying a plurality of control pulses during each of said times, such that any two successive control pulses among each plurality of control pulses have, between the starts thereof, a temporal distance $D_T$ equal to a number N multiplied by half a determined control period Treg for each of said times, that is to say a mathematical relation $D_T$=N·Treg/2, where N is a positive integer number greater than zero. Control period Treg and number N are selected to allow synchronization of the mechanical oscillator at a control frequency Freg=1/Treg during each of said times. The control device is arranged to determine, by means of the reference time base, the start of each of the control pulses, in order to satisfy the aforementioned mathematical relation between the temporal distance and the control period, and thus to determine the control frequency.

According to an advantageous variant, temporal distance $D_T$ is equal to an odd number 2M−1 multiplied by half a determined control period Treg for each of said times, that is to say a mathematical relation $D_T$=(2M−1)·Treg/2, where M is a positive integer number greater than zero. Control period Treg and number M are selected to allow synchronization of the mechanical oscillator at a control frequency Freg=1/Treg during each of said times.

In a first main embodiment, said times are contiguous and together form a continuous time window. The control device is arranged to apply the control pulses during the continuous time window, such that any two successive control pulses occurring in this continuous time window have, between the starts thereof, the temporal distance $D_T$ where control period Treg is equal to a desired period T0*c*, which is the inverse of the desired frequency F0*c*, in order to continually synchronize, after any initial transitory phase, the frequency of the mechanical oscillator at a desired frequency F0*c* during the continuous time window.

In a particular variant, during the continuous time window, the control device is arranged to periodically apply the control pulses with a trigger frequency $F_D$ (N)=2·F0*c*/N in the general variant set out above, respectively $F_D$ (M)=2·F0*c*/(2M−1) in the advantageous variant also mentioned above. In a preferred variant, the number N, respectively M is constant and predefined for the continuous time window.

According to a second main embodiment, the timepiece further includes a device for measuring a temporal drift in operation of the mechanical oscillator relative to its desired frequency F0*c*, and the control device is arranged to select, prior to each of said times, for control period Treg, depending on whether at least a certain positive or negative temporal drift is detected, respectively a first correction period Tcor1 which is greater than a desired period T0*c*, equal to the inverse of the desired frequency, or a second correction period Tcor2 which is less than the desired period. Each of said times is provided with sufficient duration to establish a synchronous phase in which the frequency of the mechanical oscillator is synchronized either at a first correction frequency Fcor1=1/Tcor1 when said at least one certain positive temporal drift is detected prior to the time concerned, or at a second correction frequency Fcor2=1/Tcor2 when said at least one certain negative temporal drift is detected prior to the time concerned.

According to a preferred variant, when said at least one certain positive or negative temporal drift is detected, the control device is arranged to periodically apply, during the next time of said times, the corresponding plurality of control pulses respectively with a first frequency $F_{INF}$, according to the aforementioned variant $F_{INF}$=2·Fcor1/N or $F_{INF}$=2·Fcor1/(2M−1), or with a second frequency $F_{SUP}$, according to the aforementioned variant $F_{SUP}$=2·Fcor2/N or $F_{SUP}$=2·Fcor2/(2M−1). In particular, the number N, respectively M, is constant during each of said times and it is either predetermined or determined prior to the next time concerned.

As a result of the features of the timepiece according to the invention, it is thus possible to correct both a time gain and a time loss in the natural running/operation of a mechanical movement by acting through control pulses, each having a limited duration, which vary the resistance between the at least two electrodes of the balance spring which is at least partially formed of a piezoelectric material.

In the first main embodiment, the distinct control pulses are applied without interruption and the times at which they are triggered are determined such that the frequency of the mechanical oscillator is permanently synchronized at a desired frequency, so that there is no temporal drift after an initial phase, allowing the desired synchronization to be obtained. This first embodiment is very advantageous due to the simplicity of its electronic circuit.

In the second main embodiment, advantage is taken of the fact that the control system generates an induced voltage between the two electrodes of the balance spring, which makes it easy to count the vibrations or periods of the mechanical oscillator and therefore to detect a temporal drift in operation of the timepiece. In this case, control pulses are applied only at separate times and only when a certain temporal drift is detected, in a differentiated manner depending on whether this temporal drift is positive or negative, to correct the temporal drift.

BRIEF DESCRIPTION OF THE DRAWINGS

The invention will be described in more detail below with reference to the annexed drawings, given by way of non-limiting example, in which.

DETAILED DESCRIPTION OF THE INVENTION

Figure 2:
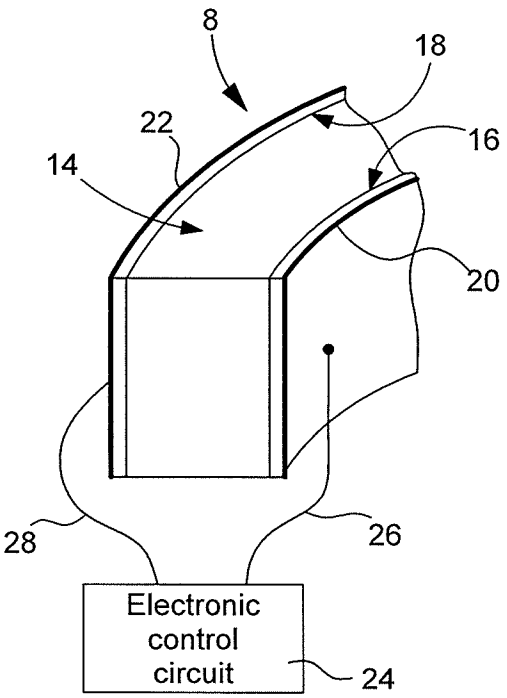
Fig. 2 (Prior art)
FIG. 2 is an enlargement of a portion of the piezoelectric balance spring of FIG. 1.
Figure 1:
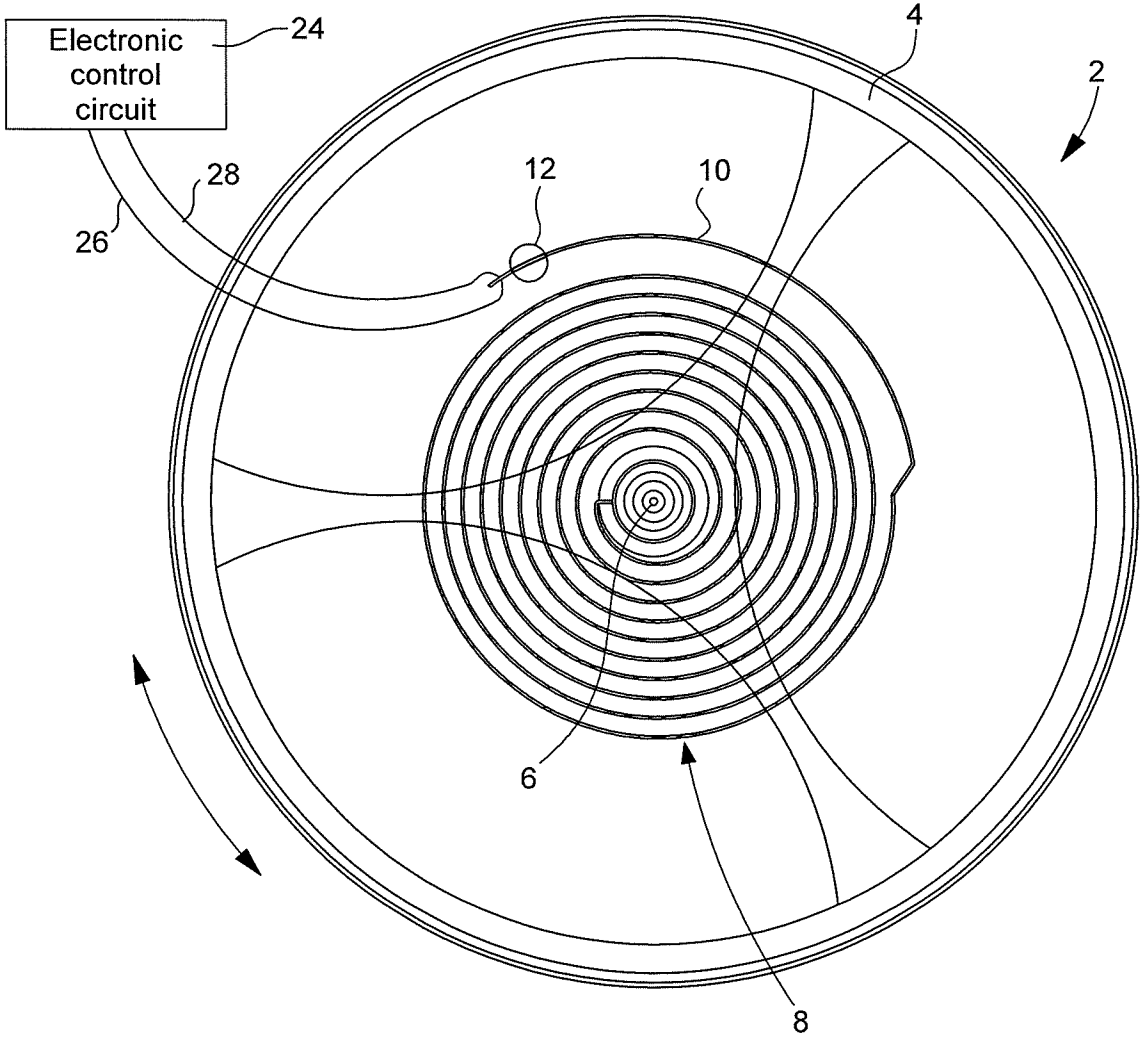
Fig. 1 (Prior art)
FIG. 1, already described, shows a prior art timepiece including a mechanical resonator, formed of a balance and a piezoelectric balance spring, and an electronic control circuit which is connected to both electrodes of the piezoelectric balance spring.
Figure 3:
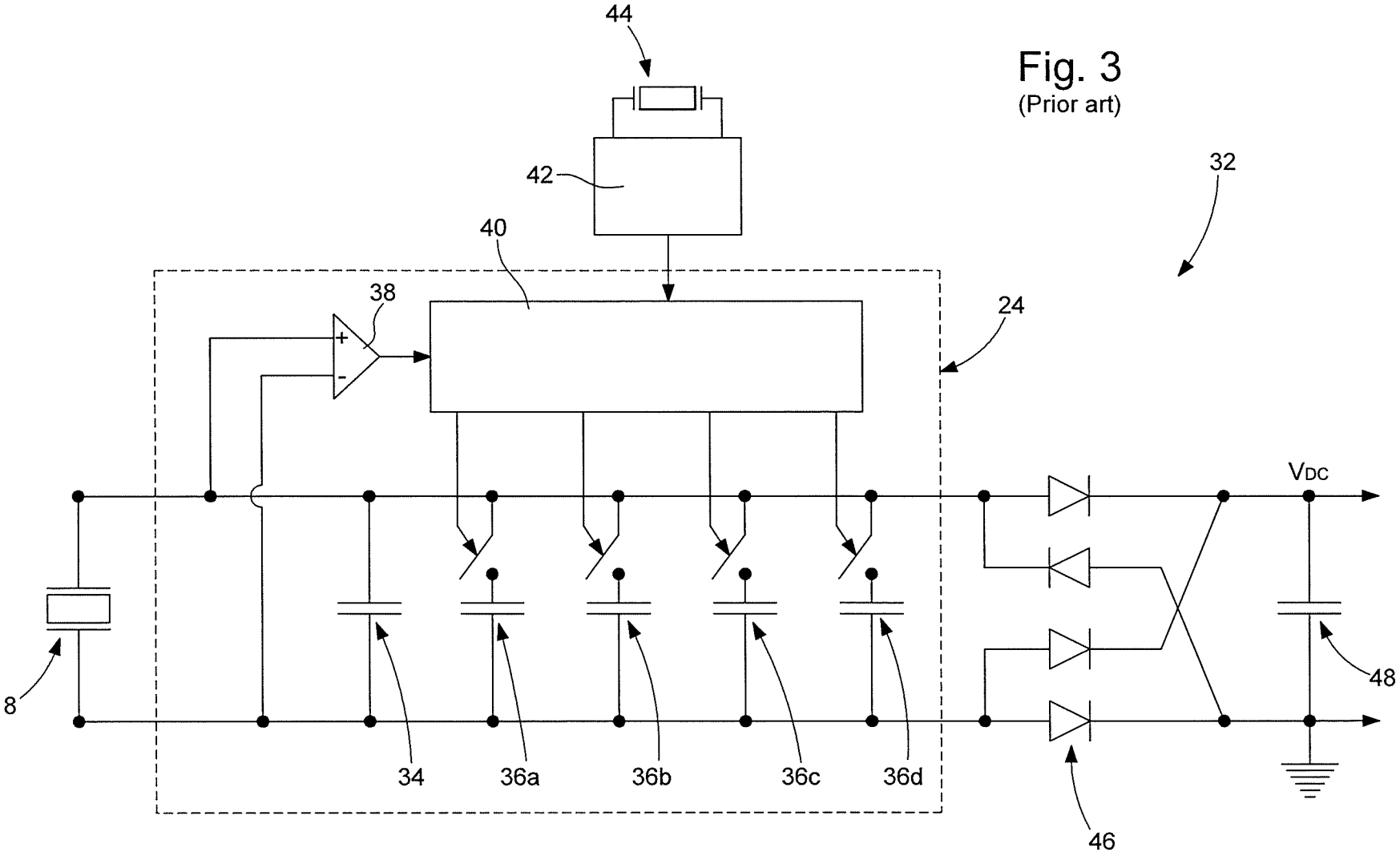
Fig. 3 (Prior art)
FIG. 3 partially shows the electrical diagram of the timepiece control device of FIG. 1.
Figure 4:
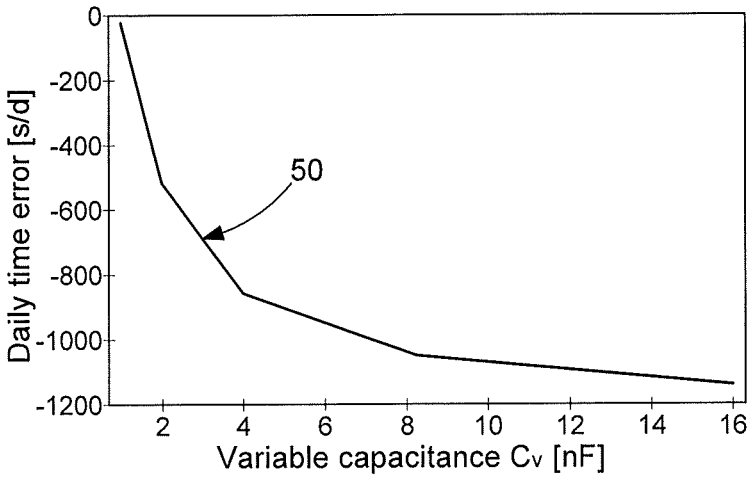
Fig. 4 (Prior art)
FIG. 4 shows the daily time error for the timepiece of the preceding Figures as a function of a variable capacitance applied between the two electrodes of the piezoelectric balance spring.

The timepiece according to the invention comprises, like the prior art timepiece described above, a mechanical timepiece movement provided with a mechanical oscillator, formed by a balance and a piezoelectric balance spring, for example as represented in FIGS. 1 and 2, and arranged to time the running of the timepiece movement, wherein this mechanical oscillator has a predefined desired frequency F0*c*. The balance spring is at least partially formed of a piezoelectric material and includes at least two electrodes 20, 22 arranged to be capable of having between them a voltage induced by the piezoelectric material when the latter is under mechanical stress during oscillation of the mechanical oscillator. The timepiece also includes a control device arranged to be capable of controlling the mean frequency of the mechanical oscillator and including an auxiliary time base, formed by an auxiliary electronic oscillator and providing a reference frequency signal. The two electrodes of the balance spring are electrically connected to the control device which is arranged to be capable of varying the impedance of the control system, which is formed by the piezoelectric material, the two electrodes and the control device, According to the invention, the control device is arranged to be capable of momentarily varying the electrical resistance generated by the control device between the two electrodes of the balance spring, in order to generate, at least at times, control pulses which are distinct and each have a certain duration $T_P$, each control pulse consisting of a momentary decrease in the electrical resistance of the control system, namely the aforementioned electrical resistance relative to a nominal electrical resistance, which is generated by the control device between the two electrodes outside the control pulses. Generally, the control device is arranged to be capable of applying, at least at times, a plurality of control pulses during each of these times, such that any two successive control pulses among each plurality of control pulses have, between the starts thereof, a temporal distance $D_T$ equal to a number N multiplied by half a determined control period Treg for each of said times, that is to say a mathematical relation $D_T$=N·Treg/2, where N is a positive integer number greater than zero. Control period Treg and number N are selected to allow synchronization of the mechanical oscillator at a control frequency Freg=1/Treg during each of said times, as will be explained in detail below. The control device is arranged to determine, by means of the reference time base, the start of each of said control pulses, in order to satisfy the aforementioned mathematical relation between the temporal distance $D_T$ and the control period Treg, and thus to determine the control frequency.

In an advantageous variant, temporal distance $D_T$ is equal to an odd number 2M−1 multiplied by half a determined control period Treg for each of said times, that is to say a mathematical relation $D_T$=(2M−1)·Treg/2, where M is a positive integer number greater than zero. This variant, which selects odd numbers among the possible values for the aforementioned number N in the general variant set out above, is advantageous, since, according to observations made by the inventors, selecting an odd number results in greater control efficiency compared to the use of an even number for number N.

Preferably, during each time in which a plurality of control pulses occurs, the control device is arranged to periodically apply the control pulses with a trigger frequency $F_D$ (N)=2·Freg/N for the general variant, and $F_D$ (M)=2·Freg/(2M−1) for the aforementioned advantageous variant.

In the context of the development that led to the present invention, the inventors brought to light an entirely remarkable physical phenomenon in relation to a mechanical oscillator formed by a balance and a piezoelectric balance spring; this physical phenomenon makes it possible, according to the invention, to regulate the mean frequency of a mechanical oscillator incorporated in a mechanical movement by means of an electronic control device, as set out above. Next, the inventors defined two types of control based on this physical phenomenon, which are respectively implemented in two main embodiments which will be described in detail below. To explain this physical phenomenon, FIG. 5 shows the behaviour of a mechanical oscillator equipped with a piezoelectric balance spring, of the type described above, to which short short-circuit pulses are periodically applied, for example less than one tenth of a desired period T0*c* (in the case represented, the duration of short-circuit pulses is 10 ms, namely one twentieth of the desired period T0*c*=200 ms), the mechanical oscillator and the mechanical movement that incorporates the same being designed to function naturally substantially at a desired frequency F0*c*, equal, by definition, to the inverse of the desired period.

Figure 5:
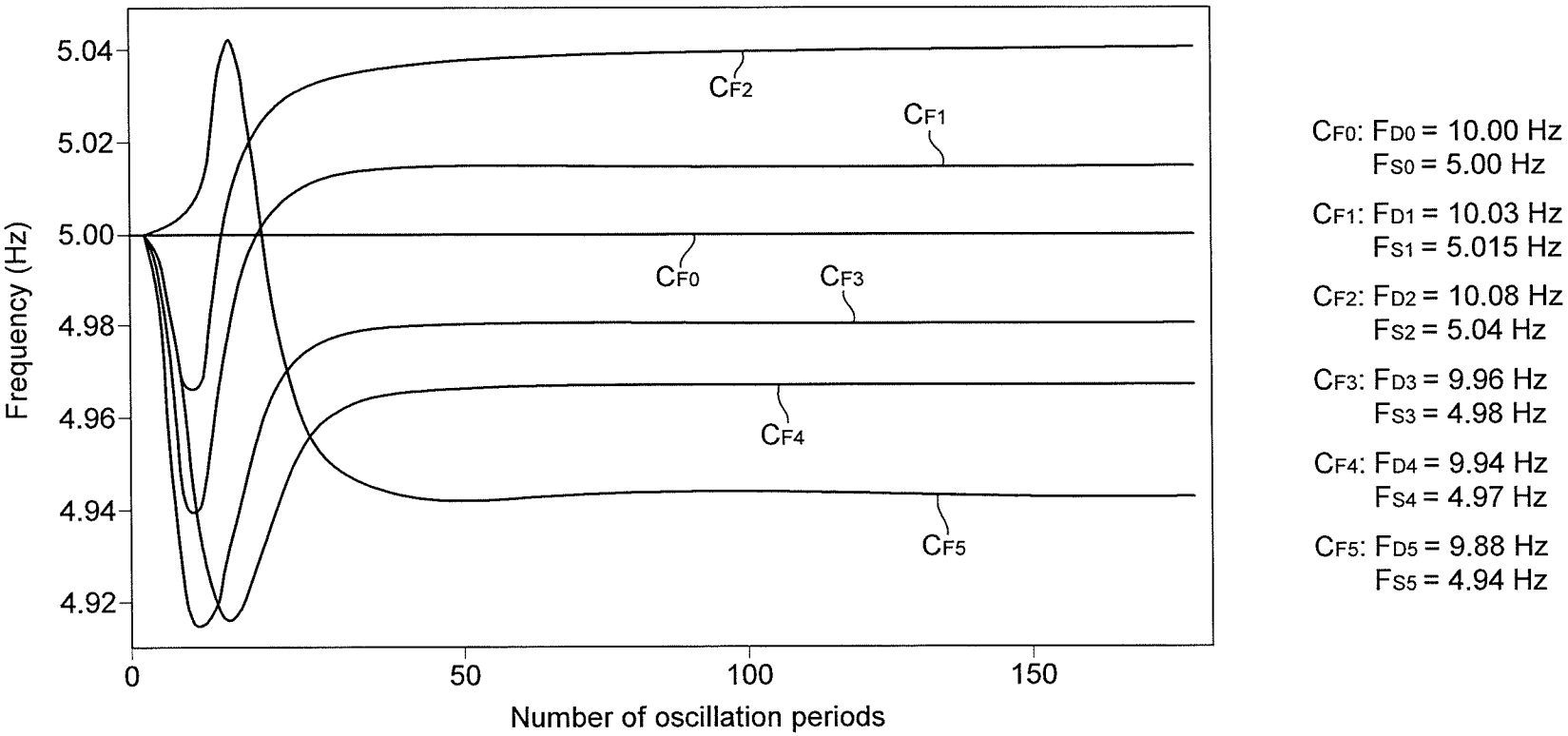
FIG. 5 shows the evolution of the oscillation frequency of the mechanical resonator during periodic application of control pulses at various trigger frequencies for these control pulses around a frequency equal to twice a desired frequency for the mechanical oscillator of the timepiece.

In the example represented in FIG. 5, natural frequency F0 of the mechanical oscillator is exactly equal to its desired frequency F0*c*=5 Hz and short-circuit pulses, forming control pulses according to the invention, are applied here with a trigger frequency $F_D$ close to twice the desired frequency but different, that is to say, FD≈2·F0*c*, in addition to the specific case of a trigger frequency FD exactly equal to twice the natural frequency and thus to twice the desired frequency. Various curves show the temporal evolution of the frequency of the mechanical oscillator for various trigger frequencies (for N=M=1 in the formula of the aforementioned trigger frequency $F_D$ (N), respectively $F_D$ (M)) during times in which a plurality of periodic short-circuit pulses are applied. The following results are obtained:

Curve $C_{F0}$ corresponds to a short-circuit pulse trigger frequency $F_{D0}$=10.00 Hz, and it is observed that the oscillation frequency stabilises at the desired frequency $F_{S0}$=F0*c*=5.00 Hz;

Curves $C_{F1}$ and $C_{F2}$ correspond to short-circuit pulse trigger frequencies that are higher than $F_{D0}$, that is to say respectively $F_{D1}$=10.03 Hz and $F_{D2}$=10.08 Hz, and it is observed that the oscillation frequency is respectively synchronized at synchronization frequencies $F_{S1}$=5.015 Hz and $F_{S2}$=5.04 Hz after a transitory phase occurring at the start of each short-circuit pulse application time; and Curves $C_{F3}$, $C_{F4}$ and $C_{F5}$ correspond to short-circuit pulse trigger frequencies that are lower than $F_{D0}$, that is to say, respectively $F_{D3}$=9.96 Hz, $F_{D4}$=9.94 Hz and $F_{D5}$=9.88 Hz, and it is observed that the oscillation frequency is respectively synchronized at synchronization frequencies $F_{S3}$=4.98 Hz and $F_{S5}$=4.94 Hz after a transitory phase occurring at the start of each short-circuit pulse application time.

Remarkably, the same synchronization frequencies were obtained for short-circuit pulse trigger frequencies respectively equal to the aforementioned trigger frequencies $F_{DX}$, X=1 to 5, divided by an odd number 2M−1, where M is a positive integer number greater than zero, insofar as the ratio between the synchronization frequency and the natural frequency of the mechanical oscillator/the desired frequency is comprised between (K−1)/K and (K+1)/K where K>40·(2M−1). Similar results were obtained with division by an even number 2M and a similar condition between K and M, but it appears, a priori, that in this latter case, synchronization is not established as efficiently as for an odd number, as the effect of the short-circuit pulses is less.

From the preceding observations and considerations, we conclude that it is possible to synchronize a mechanical oscillator having a piezoelectric balance spring, as described above, by periodically applying short-circuit pulses between the two electrodes of this balance spring, at a frequency close to its natural frequency but different therefrom.

Thus, if the natural frequency deviates from the desired frequency in the usual way, i.e. from one second to around fifteen seconds per day, it is easy, by fully open loop control, to synchronize the frequency of the mechanical oscillator at the desired frequency by continually applying distinct control pulses as described above with a suitably selected trigger frequency. This application is the subject of the first main embodiment. By using the voltage induced between the balance spring electrodes when the mechanical resonator oscillates, it is easy to count the oscillation periods and to determine a temporal drift, in particular to detect when a certain positive or negative temporal drift is reached, and then, during a certain correction time, a plurality of distinct control pulses can be applied as described above, with a suitably selected trigger frequency to synchronize the oscillation of the mechanical oscillator at a different correction frequency from the desired frequency but selected to be sufficiently close to this desired frequency to allow synchronization, and thus to correct the detected temporal drift. This application, which can be considered a semi-open or semi-closed loop, is the subject of the second main embodiment.

Figure 6:
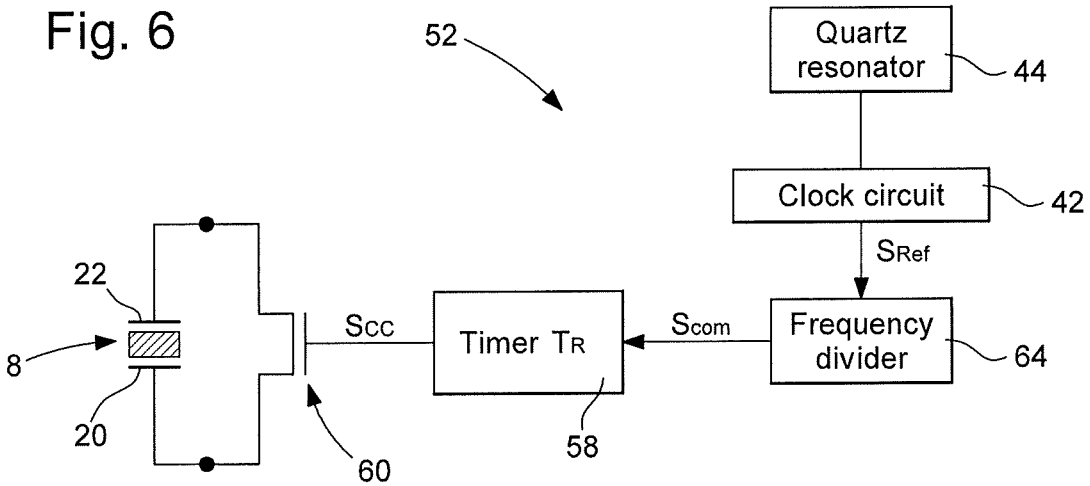
FIG. 6 shows the electrical diagram of a control device incorporated in a variant of a first main embodiment of a timepiece according to the invention.

FIG. 6 shows the electrical diagram of a first variant of the first main embodiment. The electronic circuit, which forms the entire control device 52, is very simple. A quartz resonator 44 is excited by a clock circuit 42, wherein the latter supplies a reference signal $S_{Ref}$ either at the quartz frequency $F_Q$, preferably at a frequency set at 32.768 Hz, or at a fraction of frequency $F_Q$, for example $F_Q$/4 and preferably at a fraction of the set frequency by means of an inhibition circuit known to those skilled in the art. Reference signal $S_{Ref}$ is provided to a frequency divider 64 which outputs a control signal $S_{com}$ to a timer 58 which, in response to the control signal, provides a short-circuit signal Scc to a switch 60 arranged between the two electrodes 20, 22 of piezoelectric balance spring 8 (represented schematically in FIG. 6) at the frequency imposed by the control signal. This process takes place without interruption in a continuous time window which continues as long as the control device is active, i.e. as long as it is electrically powered.

Figure 9:
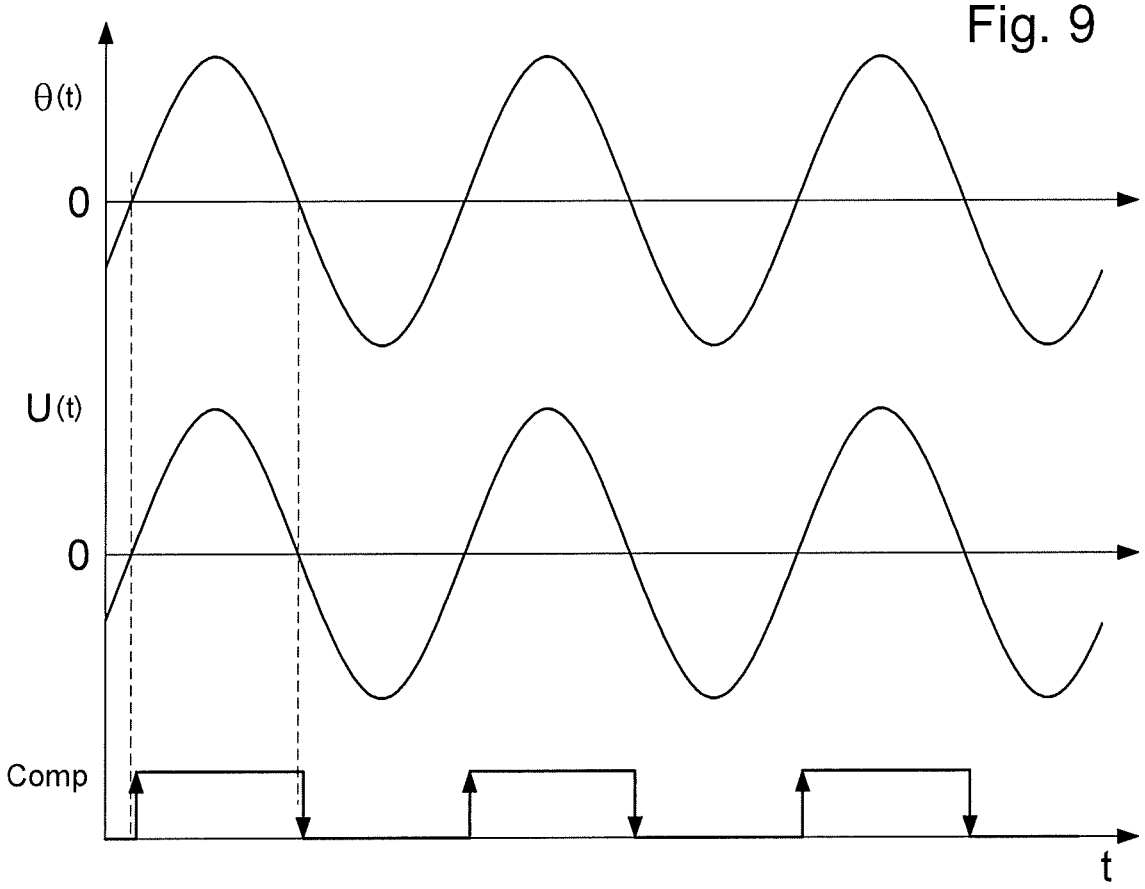
FIG. 9 shows the graph of the induced voltage between the two electrodes of the piezoelectric balance spring as a function of the angular position of the mechanical resonator, and a signal provided by a hysteresis comparator in order to compare the oscillation periods of the mechanical resonator.

Piezoelectric balance spring 8 is at least partially formed by a piezoelectric material and by at least two electrodes 20, 22 (see FIGS. 2 and 10) which are arranged to be capable of having between them a voltage U(t) induced by the piezoelectric material when the latter is subjected to mechanical stress during oscillation of the mechanical oscillator (see FIG. 9).

Control signal $S_{com}$ is a reference signal having, in a general variant, a trigger frequency $F_D$ (N)=2·F0$_c$/N, where number N is an integer number greater than zero which is selected such that, for a ratio between a maximum drift frequency in the functioning of the mechanical oscillator and the desired frequency F0*c* comprised between (K−1)/K and (K+1)/K, this number N is less than K/40, i.e. N<K/40. In an advantageous variant, control signal $S_{com}$ is a frequency signal which has a trigger frequency $F_D$ (M)=2·F0*c*/(2M−1), the number M being an integer number greater than zero, which is selected such that, for a ratio between a maximum drift frequency in the functioning of the mechanical oscillator and the desired frequency comprised between (K−1)/K and (K+1)/K, 2M−1 is less than K/40, i.e. 2M−1<K/40. Preferably, numbers N and M are constant and predefined for the continuous time window during which the short-circuit pulses, which define the control pulses, are applied.

At each pulse of the control signal, timer 58 closes switch 60 (the switch is on and therefore conductive) during a time interval $T_R$, such that the short-circuit pulses each have a duration $T_R$, which is preferably less than quarter the desired period T0*c*. In an advantageous variant, the duration of the control pulses is less than or substantially equal to one tenth of the desired period T0*c*. Thus, during the aforementioned time window, after any transitory phase during activation of the control device, continuous synchronization of the frequency of the mechanical oscillator at the desired frequency F0*c* is obtained.

Figure 7:
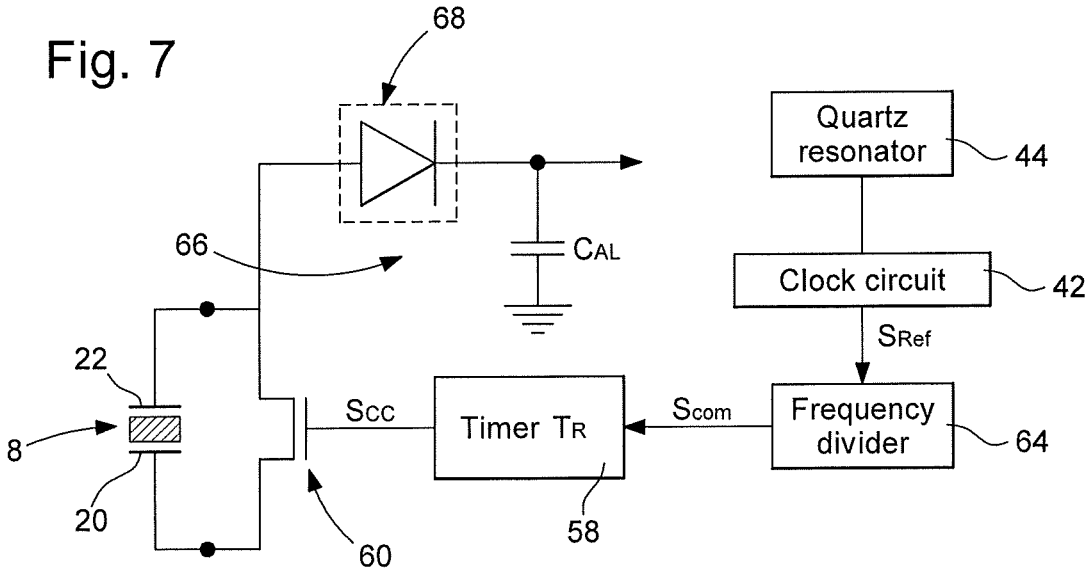
FIG. 7 shows the electrical diagram of a control device incorporated in a preferred variant of the first main embodiment.

FIG. 7 represents the electronic diagram of a control device, identical to that described above, which is combined with a power circuit 66, formed of a rectifier 68 of a voltage U(t) induced between the two electrodes 20, 22 of balance spring 8, when the mechanical oscillator oscillates and arranged to power control device 62, the rectified voltage being stored in a storage capacitor $C_{AL}$, such that the control device and the power circuit form an autonomous unit. In an advantageous variant, this autonomous unit is carried by the balance 4 (see FIG. 1) to which it is secured.

Figure 8:
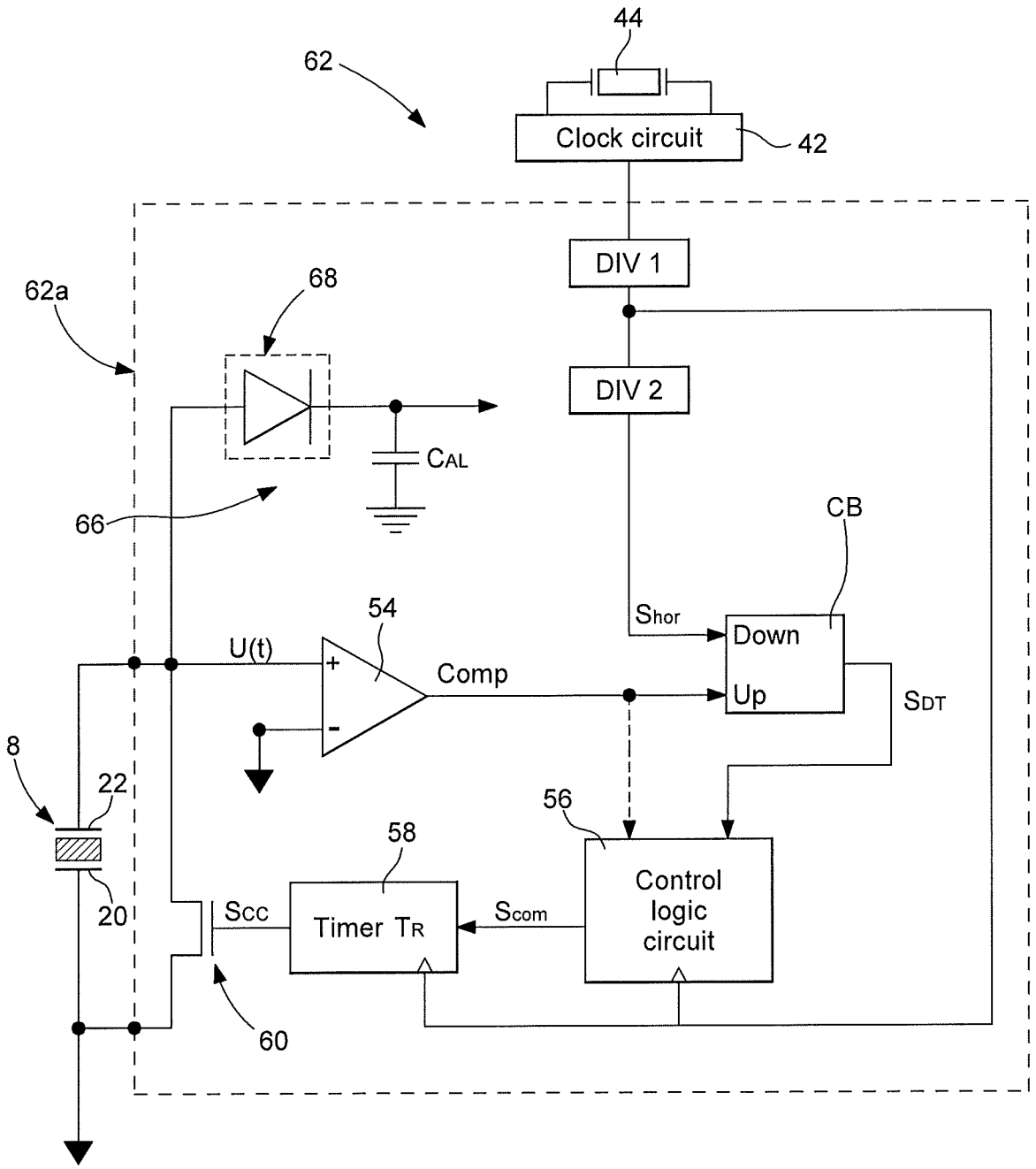
FIG. 8 shows the electrical diagram of a control device incorporated in a variant of a second main embodiment of a timepiece according to the invention.

FIG. 8 shows the electronic diagram of an advantageous variant of the second main embodiment. The timepiece includes a control device 62 formed by an electronic control circuit 62*a* and an auxiliary time base which includes an auxiliary oscillator, and which provides a reference signal $S_{Ref}$ to the electronic control circuit. This time base includes, for example, a quartz resonator 44 and a clock circuit 42 which supplies reference signal $S_{Ref}$ described with reference to the first main embodiment, to a divider having at least two stages DIV1 and DIV2, this divider being contained in circuit 62*a*. Piezoelectric balance spring 8 is similar to that described in the first main embodiment and its two electrodes 20, 22 are electrically connected to electronic control circuit 62*a*.

The electronic control circuit includes a device for measuring for any temporal drift in the running/operation of the timepiece movement compared to a desired frequency for the mechanical oscillator, which is determined by the auxiliary time base 42, 44. The measuring device is formed by a hysteresis comparator 54 whose two inputs are connected to the two electrodes 20, 22 of piezoelectric balance spring 8. It will be noted that in the example shown, electrode 20 is electrically connected to an input of comparator 54 via the mass of the control device. The hysteresis comparator supplies a digital signal 'Comp' (see FIG. 9) whose logic state changes just after each passage of the mechanical oscillator through its neutral position (angular position 8(*t*) equal to zero), and thus after each zero crossing of the mechanical resonator forming this mechanical oscillator. The induced voltage U(t) generated by the piezoelectric balance spring is zero during passage of the mechanical resonator through its neutral position (angular position 'zero'), whereas it is maximum, for a given load applied between the two electrodes, when the mechanical resonator is in one or other of its two extreme positions (defining the amplitude of the mechanical oscillator respectively on both sides of the neutral position), as shown in FIG. 9.

Signal 'Comp' is provided to a first input 'Up' of a two-directional counter CB forming the measuring device. The two-directional counter is thus incremented by one unit at each oscillation period of the mechanical oscillator (particularly on each rising edge of the signal). It thus continuously receives a measurement of the instantaneous oscillation frequency of the mechanical oscillator. The two-directional counter receives at its second input 'Down' a clock signal $S_{hor}$ provided by the frequency divider DIV1 & DIV2, this clock signal corresponding to a desired frequency F0*c* for the mechanical oscillator which is determined by the auxiliary oscillator of the auxiliary time base. Thus, the two-directional counter provides to control logic circuit 56 a signal $S_{DT}$ corresponding to a cumulative error over time between the oscillation frequency of the mechanical oscillator and the desired frequency, this cumulative error defining the temporal drift of the mechanical oscillator relative to the auxiliary oscillator.

Next, control device 62 includes a switch 60 formed by a transistor and arranged between the two electrodes 20, 22 of balance spring 8, this switch being controlled by control logic circuit 56, which is arranged to be capable of momentarily closing the switch, via a timer 58, so that it is on/conductive during the control pulses, which then define short-circuit pulses. The control circuit selectively provides a control signal $S_{com}$ to timer 58 which, in response to this control signal, momentarily closes transistor 60 by applying a signal $S_{CC}$ thereto. More precisely, the control circuit determines the start time of each short-circuit pulse by starting or resetting the timer ('Timer') which immediately turns on/makes transistor 60 conductive (switch closed), with the timer determining the duration $T_R$ of each short circuit pulse. At the end of each short-circuit pulse, the timer opens the switch again so that transistor 60 is off, i.e. it becomes non-conductive again. In a general variant, the control pulses each have a duration less than a quarter of the desired period T0*c* which is equal to the inverse of said desired frequency of the mechanical oscillator. In a preferred variant, the duration of the control pulses is less than or substantially equal to one tenth of a desired period.

Electronic circuit 62*a* further includes a power circuit 66 for the control device, which was described above.

The control method according to the second main embodiment, performed by control device 62 and implemented in control logic circuit 56, is explained below. The control logic circuit is arranged to be capable of determining whether a temporal drift measured by the measuring device corresponds to at least a certain gain (CB>N1) or to at least a certain loss (CB<−N2), where N1 and N2 are positive integer numbers. The control device, in particular its control logic circuit, is arranged to select, prior to each distinct correction time provided, for control period Treg as defined above, depending on whether at least a certain positive or negative temporal drift is detected, respectively a first correction period Tcor1 which is greater than desired period T0*c*, or a second correction period Tcor2 which is less than the desired period, each of the correction times being provided with sufficient duration to establish a synchronous phase in which the frequency of the mechanical oscillator is synchronized either at a first correction frequency Fcor1=1/Tcor1 when said at least one certain positive temporal drift is detected prior to the time concerned, or at a second correction frequency Fcor2=1/Tcor2 when said at least one certain negative temporal drift is detected prior to the time concerned, in order to correct the detected temporal drift.

In an advantageous variant, control logic circuit 56 is arranged such that the temporal distance $D_T$ between two short-circuit pulses in each distinct correction time, is equal to an odd number 2M−1 multiplied by half the determined control period Treg for each of said correction times, that is to say a mathematical relation $D_T$=(2M−1)·Treg/2, where M is a positive integer number greater than zero, control period Treg and number M being selected to allow synchronization of the mechanical oscillator at a control frequency Freg=1/Treg during each of the correction times.

In a particular variant, when said at least one certain positive or negative temporal drift is detected by control logic circuit 56, control device 62 is arranged to periodically apply, during the next correction time, a corresponding plurality of control pulses with respectively a first trigger frequency $F_{IN}$=2·Fcor1/N or a second trigger frequency $F_{SUP}$=2·Fcor2/N. The number N is preferably constant during each correction time and it is either predetermined or determined prior to the next correction time concerned.

In order to ensure the desired synchronization during each of the correction times, it is advantageously provided that, for each of the correction times in which first trigger frequency $F_{INF}$ occurs, the latter is higher than a first limit frequency $F_{L1}$ (N, K)=[(K−1)/K]·2·F0*c*/N where K>40·N, and for each of the correction times where the second trigger frequency occurs, the latter is lower than a second limit frequency $F_{L2}$ (N, K)=[(K+1)/K]·2·F0*c*/N where K>40·N.

In a specific variant, integer number N is lower in an initial phase than in a final phase of each of the correction times, in order to best reduce the initial transitory phase.

In a preferred variant, when said at least one certain positive or negative temporal drift is detected by control logic circuit 56, control device 62 is arranged to periodically apply, during the next correction time, a corresponding plurality of control pulses with respectively a first trigger frequency $F_{IN}$=2·Fcor1/(2M−1) or a second trigger frequency $F_{SUP}$=2·Fcor2/(2M−1). In particular, number M is constant during each correction time and it is either predetermined or determined prior to the next correction time concerned.

In order to ensure the desired synchronization during each of the correction times, it is advantageously provided that, for each of the correction times in which first trigger frequency $F_{INF}$ occurs, the latter is higher than a first limit frequency $F_{L1}$ (M, K)=[(K−1)/K]·2·F0*c*/(2M−1) where K>40·(2M−1) and for each of the correction times where the second trigger frequency $F_{SUP}$ occurs, the latter is lower than a second limit frequency $F_{L2}$ (M, K)=[(K+1)/K]·2·F0*c*/(2M−1) where K>40·(2M−1).

In a specific variant, in order to best reduce the initial transitory phase in each correction time, it is provided that the start of a first control pulse, among the plurality of control pulses provided for the correction time concerned, is determined relative to the angular position of the mechanical oscillator. To this end, signal 'Comp' is also provided to control logic circuit 56. In this specific variant, the first control pulse is triggered by a rising edge or falling edge of signal 'Comp'.

Figure 10:
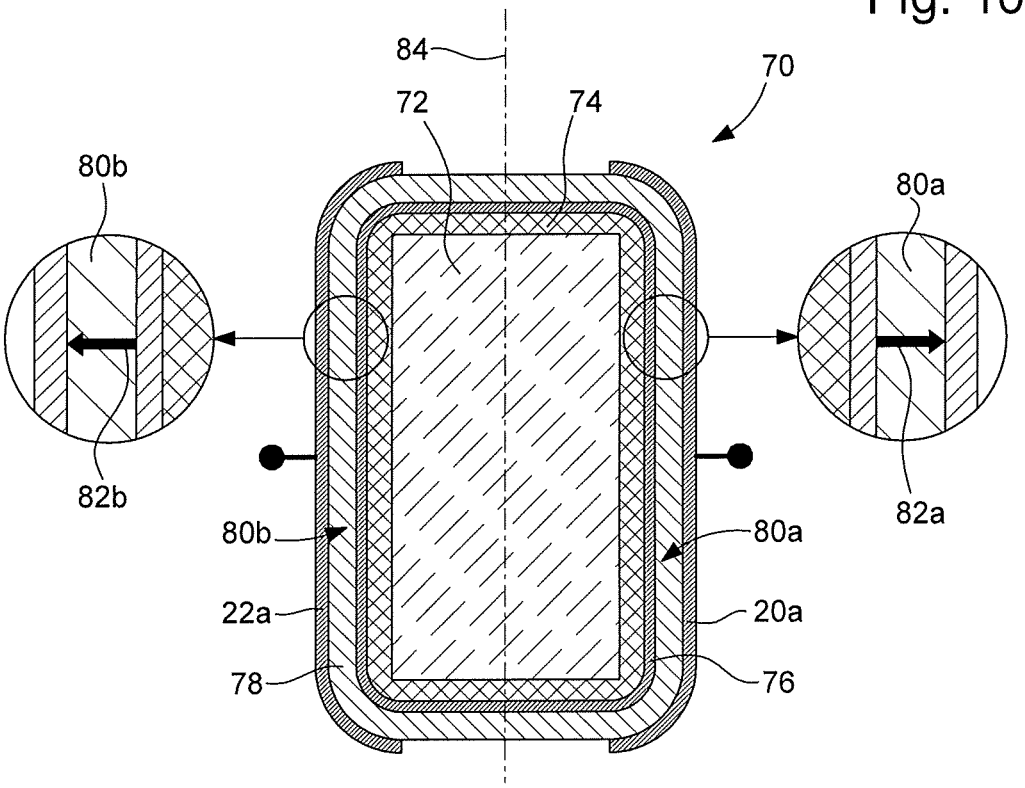
FIG. 10 is a cross-section of a preferred embodiment of a piezoelectric balance spring forming the mechanical resonator of a timepiece according to the invention.

Referring to FIG. 10, a preferred embodiment of piezoelectric balance spring 70 of the timepiece according to the invention will be described. This balance spring 70, represented in cross-section, includes a central silicon body 72, a silicon oxide layer 74 deposited at the surface of the central body for temperature compensation of the balance spring, a conductive layer 76 deposited on the silicon oxide layer, and a piezoelectric material deposited in the form of a piezoelectric layer 78 on conductive layer 76. Two electrodes 20*a* and 22*a* are arranged on piezoelectric layer 78 respectively on the two lateral sides of the balance spring (the two electrodes can partly cover the upper and lower sides of the balance spring but without joining).

In the particular variant represented in FIG. 10, the first part 80*a* and second part 80*b* of the piezoelectric layer respectively extending over the two lateral sides of central body 72 have, through their growth from conductive layer 76, respective crystallographic structures which are symmetrical with respect to a median plane 84 parallel to these two lateral sides. Thus, in the two lateral parts 80*a* and 80*b*, the piezoelectric layer has two same respective piezoelectric axes 82*a*, 82*b* which are perpendicular to the piezoelectric layer and of opposite directions. There is therefore an inversion of the sign of the induced voltage between the internal electrode and each of the two external lateral electrodes for the same mechanical stress. Thus, when the balance spring contracts or expands from its rest position, there is an inversion of mechanical stress between first and second parts 80*a* and 80*b*, i.e. one of these parts is subjected to compression while the other is subjected to traction, and vice versa. Finally, as a result of these considerations, the induced voltages in the first and second parts have the same polarity on an axis perpendicular to the two lateral sides, such that conductive layer 76 can form a single same internal electrode which extends from the two lateral sides of central body 72, this internal electrode having no electrical connection of its own to the control device. In a particular variant, the piezoelectric layer consists of an aluminium nitride crystal formed by crystal growth from conductive layer 76 (internal electrode) and perpendicular thereto.

The invention claimed is:

1. A timepiece comprising a mechanical movement which is provided with a mechanical oscillator formed by a balance and a balance spring, said mechanical oscillator having a predefined desired frequency F0*c* and being arranged to time the running of the mechanical movement, said timepiece also including a control device arranged to be capable of controlling the mean frequency of the mechanical oscillator and including an auxiliary time base, formed by an auxiliary electronic oscillator and providing a reference signal, the balance spring being at least partially formed by a piezoelectric material and by at least two electrodes arranged to be capable of having therebetween a voltage U(t) induced by said piezoelectric material when the latter is subjected to mechanical stress during an oscillation of the mechanical oscillator, the two electrodes being electrically connected to the control device which is arranged to be capable of varying the impedance of the control system, which is formed by said piezoelectric material, said at least two electrodes and the control device; characterized in that the control device is arranged to be capable of momentarily varying the electrical resistance generated by said control device between said two electrodes, in order to generate, at least at times, control pulses that are distinct and each have a certain duration each control pulse including a momentary decrease in said electrical resistance relative to a nominal electrical resistance, which is generated by the control device between said two electrodes outside said distinct control pulses, the control device being arranged to be capable of applying a plurality of said control pulses during each of said times, such that, between the starts of any two successive control pulses among each plurality of control pulses, there is a temporal distance $D_T$ equal to a number N multiplied by half of a determined control period Treg for each of said times, i.e. a mathematical relation $D_T$=N·Treg/2, where N is a positive integer number greater than zero, the control period Treg and the number N being selected to allow synchronization of the mechanical oscillator at a control frequency Freg=1/Treg during each of said times, the control device being arranged to determine, with the reference time base, the start of each of said control pulses, in order to satisfy said mathematical relation between said temporal distance and the control period, and thus to determine the control frequency.

2. The timepiece according to claim 1, wherein the timepiece further includes a device for measuring a temporal drift in functioning of the mechanical oscillator relative to its desired frequency F0*c*, and wherein the control device is arranged to select, prior to each of said times, for said control period Treg, depending on whether at least a certain positive or negative temporal drift is detected by the control device, respectively a first correction period Tcor1 which is greater than a desired period T0*c*, equal to the inverse of the desired frequency, or a second correction period Tcor2 which is less than the desired period, each of said times being provided with sufficient duration to establish a synchronous phase in which the frequency of the mechanical oscillator is synchronized either at a first correction frequency Fcor1=1/Tcor1 when said at least one certain positive temporal drift is detected prior to the time concerned, or at a second correction frequency Fcor2=1/Tcor2 when said at least one certain negative temporal drift is detected prior to the time concerned.

3. The timepiece according to claim 2, wherein the temporal distance $D_T$ is equal to an odd number 2M−1 multiplied by half of the control period Treg determined for each of said times, that is to say a mathematical relation $D_T$=(2M−1)·Treg/2, M being a positive integer number greater than zero, the control period Treg and the number M are selected to allow synchronization of the mechanical oscillator at a control frequency Freg=1/Treg during each of said times.

4. The timepiece according to claim 3, wherein, when said at least one certain positive or negative temporal drift is detected, the control device is arranged to periodically apply, during the next time among said times, the corresponding plurality of control pulses with respectively a first trigger frequency $F_{INF}$=2·Fcor1/(2M−1) or a second trigger frequency $F_{sup}$=2·Fcor2/(2M−1), the number M being constant during each of said times and it the number M is either predetermined or determined prior to the next time concerned.

5. The timepiece according to claim 4, wherein, for each of said times where the first trigger frequency $F_{INF}$ occurs, the latter is higher than a first limit frequency $F_{L1}$ (M, K)=[(K−1)/K]·2·F0*c*/(2M−1) where K>40 (2M−1) and for each of said times where the second trigger frequency $F_{SUP}$ occurs, the latter is lower than a second limit frequency $F_{L2}$(M, K)=[(K+1)/K]·2·F0*c*/(2M−1) where K>40(2M−1).

6. The timepiece according to claim 2, wherein, when said at least one certain positive or negative temporal drift is detected, the control device is arranged to periodically apply, during the next time of said times, the corresponding plurality of control pulses with respectively a first trigger frequency $F_{INF}$=2·Fcor1/N or a second trigger frequency $F_{SUP}$=2·Fcor2/N, the number N being constant during each of said times and it is either predetermined or determined prior to the next time concerned.

7. The timepiece according to claim 6, wherein, for each of said times in which the first trigger frequency $F_{INF}$ occurs, the latter is higher than a first limit frequency $F_{L1}$ (N, K)=[(K−1)/K]·2·F0*c*/N where K>40·N, and, for each of said times in which the second trigger frequency $F_{INF}$ occurs, the latter is lower than a second limit frequency $F_{L2}$ (N, K)=[(K+1)/K]·2·F0*c*/N.

8. The timepiece according to claim 2, wherein the control pulses each have a duration of less than a quarter of the desired period T0*c*.

9. The timepiece according to claim 2, characterized in that wherein the duration of said control pulses is less than or equal to one tenth of the desired period T0*c*.

10. The timepiece according to claim 1, wherein said times are contiguous and together form a continuous time window; and in that wherein the control device is arranged to apply said control pulses during the continuous time window, such that any two successive control pulses occurring in said continuous time window have, between the starts thereof, said temporal distance $D_T$ where said control period Treg is equal to a desired period T0*c*, which is the inverse of the desired frequency F0*c*, in order to continually synchronize, after any initial transitory phase, the frequency of the mechanical oscillator at the desired frequency F0*c* during the continuous time window.

11. The timepiece according to claim 10, wherein the temporal distance $D_T$ is equal to an odd number 2M−1 multiplied by half of the desired period T0*c*, that is to say a mathematical relation $D_T$=(2M−1)·Treg/2, M being a positive integer number greater than zero, the number M being selected to allow synchronization of the mechanical oscillator at the desired frequency F0*c*=1/T0*c* during the continuous time window after any initial transitory phase.

12. The timepiece according to claim 11, wherein the control device is arranged to periodically apply, during the continuous time window, the control pulses with a trigger frequency $F_D$ (N)=2·F0*c*/(2M−1), the number M being selected such that, for a ratio between a maximum drift frequency in the functioning of the mechanical oscillator and the desired frequency comprised between (K−1)/K and (K+1)/K, 2M−1<K/40.

13. The timepiece according to claim 12, characterized in that wherein the number M is constant and predefined for the continuous time window.

14. The timepiece according to claim 10, wherein the control device is arranged to periodically apply, during the continuous time window, the control pulses with a trigger frequency $F_D$ (N)=2·F0*c*/N, the number N being selected such that, for a ratio between a maximum drift frequency in the functioning of the mechanical oscillator and the desired frequency comprised between (K−1)/K and (K+1)/K, this number N<K/40.

15. The timepiece according to claim 14, wherein the number N is constant and predefined for the continuous time window.

16. The timepiece according to claim 10, wherein the control pulses each have a duration of less than a quarter of the desired period T0*c*.

17. The timepiece according to claim 10, wherein the duration of said control pulses is less than or equal to one tenth of the desired period T0*c*.

18. The timepiece according to claim 1, wherein the control device includes a switch arranged between the two electrodes of the piezoelectric balance spring, said switch being controlled by a control circuit which is arranged to momentarily close said switch during said control pulses in order turn on/make the switch conductive, these control pulses then defining short-circuit pulses.

19. The timepiece according to claim 1, wherein said balance spring includes a central silicon body, a silicon oxide layer deposited at the surface of said central body for temperature compensation of the balance spring, a conductive layer deposited on the silicon oxide layer, and said piezoelectric material deposited in the form of a piezoelectric layer on said conductive layer, said two electrodes being arranged on the piezoelectric layer respectively on the two lateral sides of the balance spring.

20. The timepiece according to claim 19, wherein first and second parts of the piezoelectric layer, which extend respectively over the two lateral sides of said central body, have respective crystallographic structures which are symmetrical with respect to a median plane parallel to said two lateral sides; and wherein said conductive layer forms a single same internal electrode which extends over the two lateral sides of the central body, said internal electrode having no electrical connection of its own to the control device.

21. The timepiece according to claim 20, wherein said piezoelectric layer consists of an aluminium nitride crystal formed by crystal growth perpendicular to said conductive layer and from said conductive layer.

22. The timepiece according to claim 1, wherein the control device includes or is combined with a power circuit, formed of a rectifier of a voltage U(t) induced between the two electrodes of the piezoelectric balance spring when the mechanical oscillator oscillates and arranged to power the control device, such that the control device and the power circuit form an autonomous unit; and wherein said autonomous unit is carried by the balance to which it is secured.

* * * * *